US010770001B2

(12) United States Patent
Park et al.

(10) Patent No.: US 10,770,001 B2
(45) Date of Patent: Sep. 8, 2020

(54) FLICKER QUANTIFICATION SYSTEM AND METHOD OF DRIVING THE SAME

(71) Applicant: Samsung Display Co., Ltd., Yongin-si, Gyeonggi-do (KR)

(72) Inventors: Se Hyuk Park, Yongin-si (KR); Hui Nam, Yongin-si (KR); Hyo Jin Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/542,125

(22) Filed: Aug. 15, 2019

(65) Prior Publication Data

US 2020/0105198 A1 Apr. 2, 2020

(30) Foreign Application Priority Data

Oct. 2, 2018 (KR) ..... 10-2018-0117765

(51) Int. Cl.
*G09G 3/3258* (2016.01)
*G09G 3/3266* (2016.01)
*G09G 3/3275* (2016.01)

(52) U.S. Cl.
CPC ..... *G09G 3/3258* (2013.01); *G09G 3/3266* (2013.01); *G09G 3/3275* (2013.01); *G09G 2320/0247* (2013.01); *G09G 2330/023* (2013.01); *G09G 2330/028* (2013.01); *G09G 2340/16* (2013.01); *G09G 2360/145* (2013.01)

(58) Field of Classification Search
None
See application file for complete search history.

(56) References Cited

U.S. PATENT DOCUMENTS 8,755,613 B2 6/2014 Yang et al.
9,607,562 B2 3/2017 Kim et al.
(Continued)

FOREIGN PATENT DOCUMENTS

KR 10-2016-0015451 A 2/2016

OTHER PUBLICATIONS

"Digital Imaging and Communications in Medicine (DICOM), Part 14: Grayscale Standard Display Function", National Electrical Manufacturers Association, PS 3.14-2004, pp. 1-55.

*Primary Examiner* — Matthew Yeung
(74) *Attorney, Agent, or Firm* — Lewis Roca Rothgerber Christie LLP

(57) ABSTRACT

A flicker quantification system includes a display device driven in units of reference periods having a first frame for writing data and at least one second frame for holding data. A luminance measurer generates luminance data by measuring a luminance of a display during the reference period. A voltage measurer measures a voltage of a photo sensor corresponding to light emitted. First voltage data representing an accumulation amount of voltage during the first frame and second voltage data representing an accumulation amount of voltage during the at least one second frame is generated. A processor calculates a flicker index value representing a ratio of a measured luminance difference to a just noticeable difference, based on the luminance data, the first voltage data, and the second voltage data. The measured luminance difference may represent the difference between a luminance during the first frame and a luminance during the second frame.

18 Claims, 10 Drawing Sheets

(56) References Cited

U.S. PATENT DOCUMENTS

| | | | | |
|---|---|---|---|---|
| 2016/0227135 | A1* | 8/2016 | Matolin | H04N 5/335 |
| 2018/0151124 | A1* | 5/2018 | An | G09G 3/3291 |
| 2018/0191939 | A1* | 7/2018 | Yan | H04N 9/68 |

* cited by examiner

FIG. 8A

| P [Hz] | Q [Hz] | G | F [nit] | JND [nit] | JFI | CV |
|---|---|---|---|---|---|---|
| 60 | 1 | 255 | 0.21 | 2.37 | 0.09 | 0 |
| | | ⋮ | | | | |
| | | 127 | 0.44 | 0.56 | 0.79 | 0 |
| | | ⋮ | | | | |
| | | 87 | 0.27 | 0.28 | 0.96 | 0 |
| | | ⋮ | | | | |
| | | 31 | 0.08 | 0.05 | 1.6 | 1 |
| | | ⋮ | | | | |
| | | 0 | 0 | 0.01 | 0 | 0 |

⋮

| P [Hz] | Q [Hz] | G | F [nit] | JND [nit] | JFI | CV |
|---|---|---|---|---|---|---|
| 60 | 59 | 255 | 0.58 | 2.37 | 0.24 | 0 |
| | | ⋮ | | | | |
| | | 127 | 0.44 | 0.56 | 0.79 | 0 |
| | | ⋮ | | | | |
| | | 87 | 0.10 | 0.28 | 0.36 | 0 |
| | | ⋮ | | | | |
| | | 31 | 0.02 | 0.05 | 0.40 | 0 |
| | | ⋮ | | | | |
| | | 0 | 0 | 0.01 | 0 | 0 |

FIG. 8B

| P [Hz] | Q [Hz] | G | JFI | CV |
|---|---|---|---|---|
| 60 | 0.1 | 255 | 0.5 | 0 |
| | | ⋮ | | |
| | | 0 | 0 | 0 |

| P [Hz] | Q [Hz] | G | JFI | |
|---|---|---|---|---|
| 120 | 0.1 | 255 | 0.9 | 0 |
| | | ⋮ | | |
| | | 0 | 0 | |

| P [Hz] | Q [Hz] | G | JFI | CV |
|---|---|---|---|---|
| 60 | 1 | 255 | 0.09 | 0 |
| | | ⋮ | | |
| | | 0 | 0 | 0 |

| P [Hz] | Q [Hz] | G | JFI | CV |
|---|---|---|---|---|
| 120 | 1 | 255 | 0.4 | 0 |
| | | ⋮ | | |
| | | 0 | 0 | 0 |

| P [Hz] | Q [Hz] | G | JFI | CV |
|---|---|---|---|---|
| 60 | 59 | 255 | 0.03 | 0 |
| | | ⋮ | | |
| | | 0 | 0 | 0 |

| P [Hz] | Q [Hz] | G | JFI | CV |
|---|---|---|---|---|
| 120 | 119 | 255 | 0.02 | 0 |
| | | ⋮ | | |
| | | 0 | 0 | 0 |

FLICKER QUANTIFICATION SYSTEM AND METHOD OF DRIVING THE SAME

CROSS-REFERENCE TO RELATED APPLICATION

The present application claims priority under 35 U.S.C. § 119(a) to Korean Patent Application No. 10-2018-0117765 filed on Oct. 2, 2018 in the Korean Intellectual Property Office (KIPO), the entire disclosure of which is incorporated herein by reference.

BACKGROUND

1. Field

The present disclosure generally relates to a flicker quantification system and a method of driving the same.

2. Description of the Related Art

With the development of information technologies, the importance of a display device, which is a connection medium between a user and information, has increased. Accordingly, display devices such as liquid crystal display devices, micro LED display devices, and organic light emitting display devices are increasingly used.

A display device displays a target image to a user by writing a data voltage for expressing a target gray level (e.g., a target grayscale level) in each pixel, and thereby allow for an organic light emitting diode to emit light or allow for light from a backlight unit to be polarized by controlling orientation of liquid crystals, corresponding to the data voltage.

In a low-power mode for reducing power consumption, the display device may be driven using a driving frequency relatively lower than that in a general mode.

SUMMARY

Embodiments provide a flicker quantification system capable of quantifying a flicker occurrence condition of a display device according to a driving frequency, and a method of driving the flicker quantification system.

According to an aspect of the present disclosure, there is provided a flicker quantification system including: a display device configured to be driven in the unit of a reference period having a first frame for writing data and at least one second frame for holding the data; a luminance measurer configured to generate luminance data by measuring a luminance of a display surface of the display device during the reference period; a voltage measurer configured to measure a voltage of a photo sensor corresponding to light emitted from the display surface, and to generate first voltage data representing an accumulation amount of the voltage during the first frame and second voltage data representing an accumulation amount of the voltage during the at least one second frame; and a processor configured to calculate a flicker index value representing a ratio of a measured luminance difference to a just noticeable difference, based on the luminance data, the first voltage data, and the second voltage data, wherein the measured luminance difference represents the difference between a luminance during the first frame and a luminance during the at least one second frame.

The display device may include: pixels coupled to first scan lines, second scan lines, data lines, and emission control lines; a first scan driver configured to be driven according to a first frequency, the first scan driver being configured to supply first scan signals to the first scan lines; a second scan driver configured to be driven according to a second frequency different from the first frequency, the second scan driver being configured to supply second scan signals to the second scan lines; a data driver configured to be driven according to the second frequency, the data driver being configured to supply data signals to the data lines; and an emission driver configured to supply emission control signals to the emission control lines according to the first frequency.

$$JFI=\{(A1-A2)*LDAT*P\}/\{JND*((A1-A2)*Q+A2*P)\} \quad \text{Equation 1}$$

The processor may calculate the flicker index value, using Equation 1. Here, JFI denotes the flicker index value, JND denotes the just noticeable difference, P denotes the first frequency, Q denotes the second frequency, A1 denotes the first voltage data, A2 denotes the second voltage data, and LDAT denotes the luminance data.

The display device may sequentially display images corresponding to a plurality of gray levels. The processor may perform a first operation of calculating the flicker index value for each of the plurality of gray levels.

The second scan driver may be sequentially driven according to a plurality of second frequencies. The processor may perform a second operation of performing the first operation for each of the plurality of second frequencies.

The processor may generate a quantification table by sorting the flicker index values for each of the plurality of gray levels and each of the plurality of second frequencies.

The first scan driver may be sequentially driven according to a plurality of first frequencies. The processor may perform the second operation for each of the plurality of first frequencies.

The processor may generate a quantification table by sorting the flicker index values for each of the plurality of gray levels, each of the plurality of first frequencies, and each of the plurality of second frequencies.

$$JFI=\{(A1-A2)*LDAT\}/(JND*A2) \quad \text{Equation 2}$$

The processor may calculate the flicker index value, using Equation 2. Here, JFI denotes the flicker index value, JND denotes the just noticeable difference, A1 denotes the first voltage data, A2 denotes the second voltage data, and LDAT denotes the luminance data.

The first frequency may be larger than the second frequency.

The first frequency may be 60 Hz.

According to another aspect of the present disclosure, there is provided a method of driving a flicker quantification system, the method including: generating luminance data by measuring a luminance of a display surface of a display device during a reference period, wherein the display device is driven in the unit of the reference period and the reference period includes a first frame for writing data and at least one second frame for holding the data; measuring a voltage of a photo sensor corresponding to light emitted from the display surface, and generating first voltage data representing an accumulation amount of the voltage during the first frame and second voltage data representing an accumulation amount of the voltage during the at least one second frame; and calculating a flicker index value representing a ratio of a measured luminance difference to a just noticeable difference, based on the luminance data, the first voltage data, and the second voltage data, wherein the measured luminance difference represents the difference between a luminance during the first frame and a luminance during the at least one second frame.

The display device may include: pixels coupled to first scan lines, second scan lines, data lines, and emission control lines; a first scan driver driven according to a first frequency, the first scan driver supplying first scan signals to the first scan lines; a second scan driver driven according to a second frequency different from the first frequency, the second scan driver supplying second scan signals to the second scan lines; a data driver driven according to the second frequency, the data driver supplying data signals to the data lines; and an emission driver configured to supply emission control signals to the emission control lines according to the first frequency.

The display device may sequentially display images corresponding to a plurality of gray levels. The method may further include performing a first operation of calculating the flicker index value for each of the plurality of gray levels.

The second scan driver may be sequentially driven according to a plurality of second frequencies. The method may further include performing a second operation of performing the first operation for each of the plurality of second frequencies.

The method may further include generating a quantification table by sorting the flicker index values for each of the plurality of gray levels and each of the plurality of second frequencies.

$$JFI=\{(A1-A2)*LDAT*P\}/\{JND*((A1-A2)*Q+A2*P)\} \quad \text{Equation 1}$$

In the calculating of the flicker index value, the flicker index value may be calculated using Equation 1. Here, JFI denotes the flicker index value, JND denotes the just noticeable difference, P denotes the first frequency, Q denotes the second frequency, A1 denotes the first voltage data, A2 denotes the second voltage data, and LDAT denotes the luminance data.

$$JFI=\{(A1-A2)*LDAT\}/(JND*A2) \quad \text{Equation 2}$$

In the calculating of the flicker index value, the flicker index value may be calculated using Equation 2. Here, JFI denotes the flicker index value, JND denotes the just noticeable difference, A1 denotes the first voltage data, A2 denotes the second voltage data, and LDAT denotes the luminance data.

In the flicker quantification system and the method of driving the same according to the present disclosure, a flicker occurrence condition of the display device according to a driving frequency can be quantified.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

FIGS. 8A and 8B are diagrams illustrating a quantification table according to an embodiment of the present disclosure.

DETAILED DESCRIPTION

Figure 1:
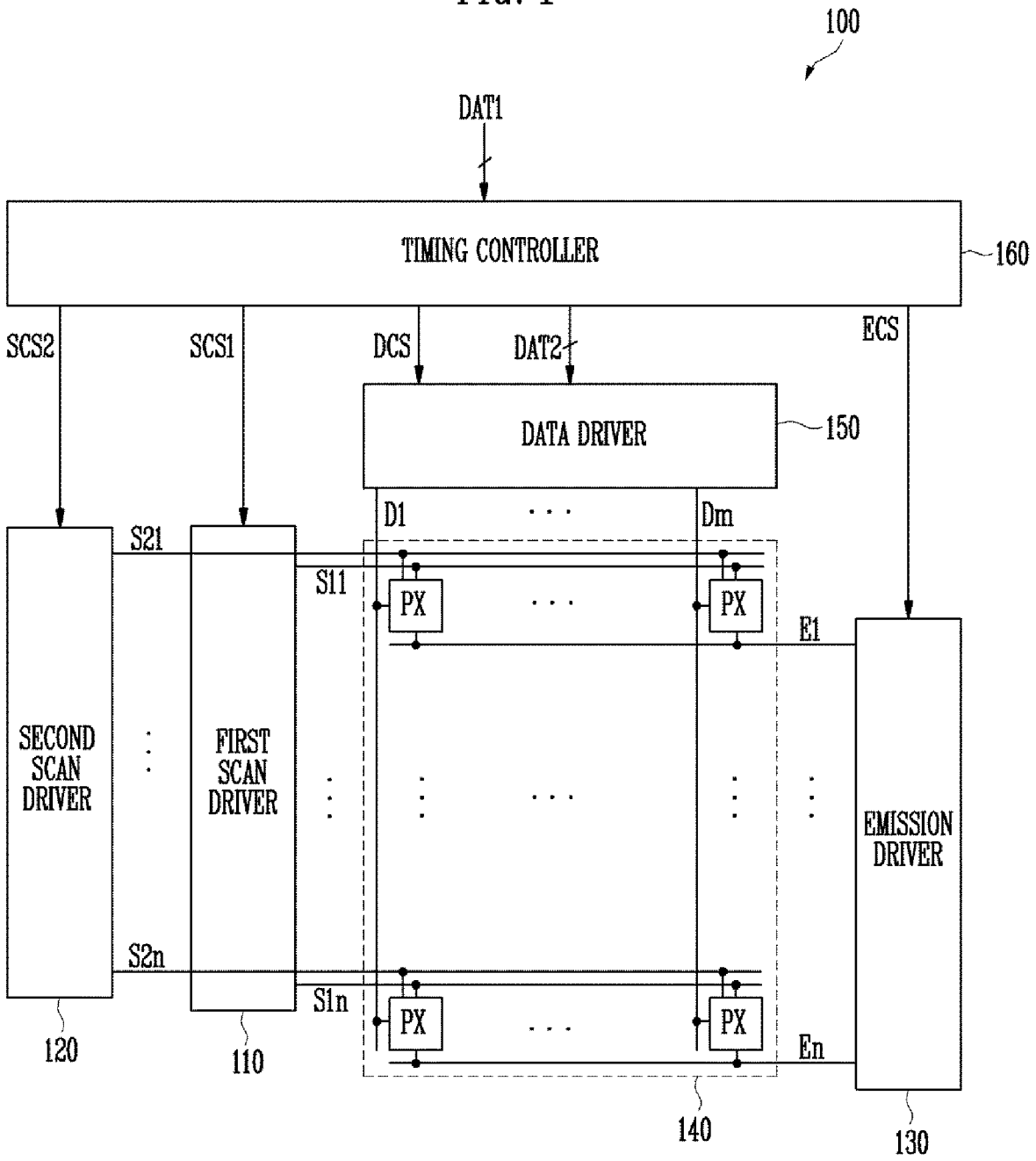
FIG. 1 is diagram illustrating a display device according to an embodiment of the present disclosure.

Hereinafter, example embodiments of a flicker quantification system will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The display or display devices and/or any other relevant devices or components according to embodiments of the flicker quantification system described herein, such as, for example, first and second scan drivers, an emission driver, a display unit, a data driver, and a timing controller, may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is diagram illustrating a display device 100 according to an embodiment of the present disclosure. An embodiment including a configuration and operation of the display device 100 driven in a first mode (i.e., a low power mode) is exemplarily described.

Referring to FIG. 1, the display device 100 may include a first scan driver 110, a second scan driver 120, an emission driver 130, a display unit 140, a data driver 150, and a timing controller 160.

The first scan driver 110 may receive a first scan control signal SCS1 from the timing controller 160. The first scan driver 110 may generate first scan signals in response to the first scan control signal SCS1. The first scan driver 110 may supply the first scan signal to first scan lines S11 to S1n (where n is a natural number). For example, the first scan driver 110 may sequentially supply the first scan signals to the first scan lines S11 to S1n. The first scan signals may have a gate-on voltage. For example, when transistors supplied with the first scan signals are of a P-type, the first scan signals may have a low level voltage.

The first scan driver 110 may be driven according to a first frequency in response to the first scan control signal SCS1.

The second scan driver 120 may receive a second scan control signal SCS2 from the timing controller 160. The second scan driver 120 may generate second scan signals in response to the second scan control signal SCS2. The second scan driver 120 may supply the second scan signals to second scan lines S21 to S2n. For example, the second scan driver 120 may sequentially supply the second scan signals to the second scan lines S21 to S2n. The second scan signals may have a gate-on voltage. For example, when transistors supplied with the second scan signals are of an N-type, the second scan signals may have a high level voltage.

The second scan driver 120 may be driven according to a second frequency in response to the second scan control signal SCS2. The second frequency may be different from the first frequency. In some embodiments, the second frequency may be lower than the first frequency.

The emission driver 130 may receive an emission driving control signal ECS from the timing controller 160. The emission driver 130 may generate emission control signals in response to the emission driving control signal ECS. The emission driver 130 may supply the emission control signals to emission control lines E1 to En. For example, the emission driver 130 may sequentially supply the emission control signals to the emission control lines E1 to En. The emission control signals may have the gate-on voltage. For example, when transistors supplied with the emission control signals are of the P-type, the emission control signals may have the low level voltage.

The emission driver 130 may be driven according to the first frequency in response to the emission driving control signal ECS.

The display unit 140 may include a substrate and pixels PX arranged on the substrate. For example, the display unit 140 may refer to a display area of a display panel.

The pixels PX may be coupled to corresponding first scan lines S11 to S1n, corresponding second scan lines S21 to S2n, corresponding emission control lines E1 to En, and corresponding data lines D1 to Dm (where m is a natural number), and be supplied with the first scan signals, the second scan signals, the emission control signals, and data signals through the first scan lines S11 to S1n, the second scan lines S21 to S2n, the emission control lines E1 to En, and the data lines D1 to Dm. As shown in FIG. 1, the pixels PX may be disposed at crossing portions of the first scan lines S11 to Sin and the data lines D1 to Dm. Each of the pixels PX may emit light at a gray level corresponding to a data signal.

The display unit 140 may further include the first scan lines S11 to S1n, the second scan lines S21 to S2n, the emission control lines E1 to En, and the data lines D1 to Dm, that are disposed on the substrate. In some embodiments, the first scan lines S11 to Sin, the second scan lines S21 to S2n, and the emission control lines E1 to En may extend in a first direction (e.g., a horizontal direction), and the data lines D1 to Dm may extend in a second direction (e.g., a vertical direction) different from the first direction. In some embodiments, any one of the pixels PX may be coupled to at least one of the first scan lines S11 to S1n, the second scan lines S21 to S2n, and the emission control lines E1 to En, and be coupled to at least one of the data lines D1 to Dm.

Meanwhile, although a case where the first scan driver 110, the second scan driver 120, the emission driver 130, the display unit 140, the data driver 150, and the timing controller 160 are components separate from each other is illustrated in FIG. 1, the present disclosure is not limited thereto. For example, at least two of the first scan driver 110, the second scan driver 120, the emission driver 130, the display unit 140, the data driver 150, and the timing controller 160 may be integrated as a single body or be mounted on the substrate of the display unit 140. For example, the display unit 140 may be the display panel.

The data driver 150 may receive a data driving control signal DCS and second data DAT2 from the timing controller 160. The data driver 150 may generate data signals, based on the data driving control signal DCS and the second data DAT2. The data driver 150 may supply the data signals to the data lines D1 to Dm. For example, the data driver 150 may supply the data signals to the data lines D1 to Dm to be synchronized with a corresponding second scan signal. The data signals supplied to the data lines D1 to Dm may be input to a pixel PX on a pixel line selected by the corresponding scan signal. In some embodiments, the data driver 150 may include a plurality of data driving integrated circuits (ICs).

The data driver 150 may be driven according to the second frequency in response to the data driving control signal DCS.

The timing controller 160 may control overall operations of the display device 100.

For example, the timing controller 160 may receive first data DAT1 and external control signals from the outside. For example, the first data DAT1 may represent an image received from the outside. The external control signals may include a vertical synchronization signal, a horizontal synchronization signal, a main clock signal, a data enable signal, and the like as would be appreciated by those skilled in the art.

The timing controller 160 may compensate for the first data DAT1, based on compensation data. For example, the compensation data may include mura compensation values of the respective pixels PX.

The timing controller 160 may generate the second data DAT2 by compensating for the first data DAT1. The timing controller 160 may also generate the data driving control signal DCS, the first scan control signal SCS1, the second scan control signal SCS2, and the emission driving control signal ECS, based on at least one of the first data DAT1 and the external control signals. The second data DAT2, the data driving control signal DCS, the first scan control signal SCS1, the second scan control signal SCS2, and the emission driving control signal ECS may be suitable for an operating condition (e.g., a frequency) of the first scan driver 110, the second scan driver 120, the emission driver 130, the display unit 140, and the data driver 150.

The timing controller 160 may transmit the first scan control signal SCS1 to the first scan driver 110.

The timing controller 160 may transmit the second scan control signal SCS2 to the second scan driver 120.

The timing controller 160 may transmit the emission driving control signal ECS to the emission driver 130.

The timing controller 160 may transmit the second data DAT2 and the data driving control signal DCS to the data driver 150.

Figure 2:
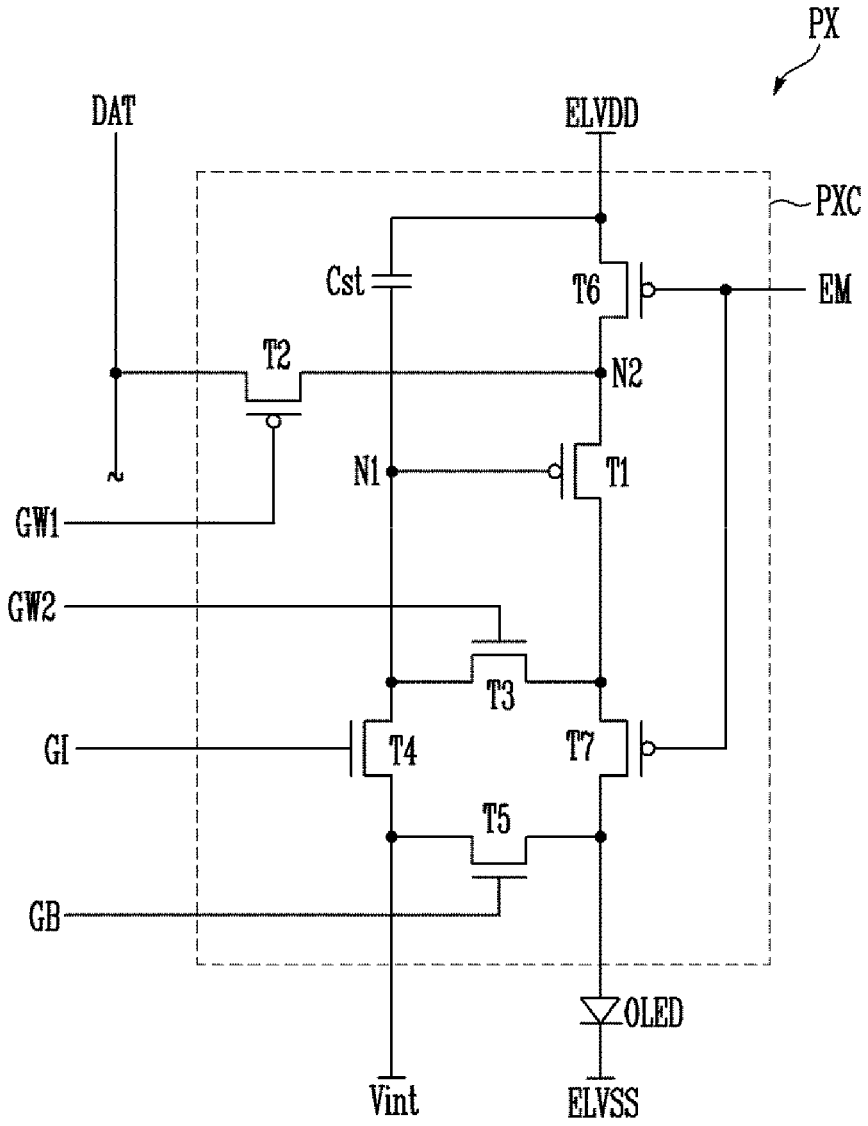
FIG. 2 is a diagram illustrating a pixel according to an embodiment of the present disclosure.

FIG. 2 is a diagram illustrating a pixel PX according to an embodiment of the present disclosure.

Referring to FIG. 2, the pixel PX may include an organic light emitting diode OLED and a pixel circuit PXC.

An anode electrode of the organic light emitting diode OLED may be coupled to the pixel circuit PXC, and a cathode electrode of the organic light emitting diode OLED may be coupled to a second power source ELVSS. The organic light emitting diode OLED may generate light with a luminance (e.g., a predetermined luminance) corresponding to an amount of driving current supplied from the pixel circuit PXC. The organic light emitting diode OLED may include an emitting layer that emits light of one of primary colors. For example, the primary colors include at least one of red, green, blue, and white. A first power source ELVDD may be set to a voltage higher than that of the second power source ELVSS such that current can flow through the organic light emitting diode OLED.

The pixel circuit PXC may control an amount of driving current flowing from the first power source ELVDD to the second power source ELVSS via the organic light emitting diode OLED, corresponding to a data signal DAT.

The pixel circuit PXC may include a first transistor T1, a second transistor T2, a third transistor T3, a fourth transistor T4, a fifth transistor T5, a sixth transistor T6, a seventh transistor T7, and a storage capacitor Cst.

A first electrode of the first transistor (driving transistor) T1 may be coupled to the first power source ELVDD through the sixth transistor T6, and a second electrode of the first transistor T1 may be coupled to the anode electrode of the organic light emitting diode OLED. In addition, a gate electrode of the first transistor T1 may be coupled to a first node N1.

The first transistor T1 may control an amount of driving current flowing from the first power source ELVDD to the second power source ELVSS via the organic light emitting diode OLED, corresponding to a voltage of the first node N1.

The first node N1 may be a node commonly coupled to the gate electrode of the first transistor T1 with electrodes of the third transistor T3, the fourth transistor T4 and the storage capacitor Cst.

In some examples, the first transistor T1 may be a P-type transistor.

The second transistor T2 may be coupled between a data line to which the data signal DAT is supplied and a second node N2. In addition, a gate electrode of the second transistor T2 may be coupled to a first scan line to which a first write signal GW1 is supplied. The second transistor T2 may be turned on when the first write signal GW1 is supplied to the first scan line. For example, the first write signal GW1 may be a current first scan signal supplied to the corresponding first scan line. When the second transistor T2 is turned on, the data line to which the data signal DAT is supplied and the second node N2 may be electrically coupled to each other. Therefore, the data signal DAT may be applied to the second node N2. The second node N2 may refer to a node to which the first transistor T1, the second transistor T2, and the sixth transistor T6 are commonly connected.

In some examples, the second transistor T2 may be a P-type transistor.

The third transistor T3 may be coupled between the second electrode of the first transistor T1 and the first node N1. In addition, a gate electrode of the third transistor T3 may be coupled to a second scan line to which a second write signal GW2 is supplied. The third transistor T3 may be turned on when the second write signal GW2 is supplied to the second scan line. For example, the second write signal GW2 may be a current second scan signal supplied to the corresponding second scan line.

When the third transistor T3 is turned on, the second electrode of the first transistor T1 and the first node N1 may be electrically coupled to each other. Therefore, the first transistor T1 may be diode-coupled.

In some examples, the third transistor T3 may be an N-type transistor.

The fourth transistor T4 may be coupled between the first node N1 and a third power source Vint. In addition, a gate electrode of the fourth transistor T4 may be coupled to a second scan line to which an initialization signal GI is supplied. The fourth transistor T4 may be turned on when the initialization signal GI is supplied to the second scan line. For example, the initialization signal GI may be a previous second scan signal supplied to the corresponding second scan line.

When the fourth transistor T4 is turned on, the first node N1 and the third power source Vint may be electrically coupled to each other. Therefore, the third power source Vint may be applied to the first node N1, and the first node N1 may be initialized to the voltage of the third power source Vint.

In some examples, the fourth transistor T4 may be an N-type transistor.

The fifth transistor T5 may be coupled between the anode electrode of the organic light emitting diode OLED and the third power source Vint. In addition, a gate electrode of the fifth transistor T5 may be coupled to a second scan line to which a black signal GB is supplied. The fifth transistor T5 may be turned on when the black signal GB is supplied to the second scan line. For example, the black signal GB may be a current second scan signal supplied to the corresponding second scan line. That is, the black signal GB and the second write signal GW2 may be the same signal.

When the fifth transistor T5 is turned on, the anode electrode of the organic light emitting diode OLED and the third power source Vint may be electrically coupled to each other. Therefore, the third power source Vint may be applied to the organic light emitting diode OLED, and the anode electrode of the organic light emitting diode OLED may be initialized to the voltage of the third power source Vint.

In some examples, the fifth transistor T5 may be an N-type transistor.

The sixth transistor T6 and the seventh transistor T7 may be located on a path of driving current.

The sixth transistor T6 may be coupled between the second node N2 and the first power source ELVDD. In addition, a gate electrode of the sixth transistor T6 may be coupled to an emission control line to which an emission control signal EM is supplied. The sixth transistor T6 may be turned on when the emission control signal EM is supplied to the emission control line. For example, the emission control signal EM may be an emission control signal supplied to the corresponding emission control line.

The seventh transistor T7 may be coupled between the anode electrode of the organic light emitting diode OLED and the second power source ELVSS. In addition, a gate electrode of the seventh transistor T7 may be coupled to the emission control line to which the emission control signal EM is supplied. The seventh transistor T7 may be turned on when the emission control signal EM is supplied to the emission control line.

In some examples, each of the sixth transistor T6 and the seventh transistor T7 may be P-type transistors.

In some embodiments, each of the first transistor T1, the second transistor T2, the sixth transistor T6, and the seventh transistor T7 may be a Low Temperature Poly Silicon (LTPS) transistor.

In some embodiments, each of the third transistor T3, the fourth transistor T4, and the fifth transistor T5 may be an oxide semiconductor.

The storage capacitor Cst may be coupled between the first power source ELVDD and the first node N1. The storage capacitor Cst may store a voltage corresponding to the data signal DAT and a threshold voltage of the first transistor T1.

Figure 3:
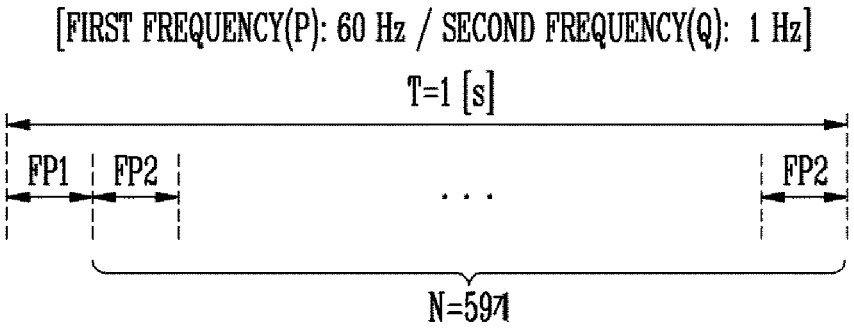
FIG. 3 is a diagram illustrating a method of driving the display device according to an embodiment of the present disclosure.

FIG. 3 is a diagram illustrating a method of driving the display device according to an embodiment of the present disclosure.

Referring to FIGS. 1-3, the display device 100 according to the embodiment of the present disclosure may be driven in the unit of a reference period T. The display device 100 may display at least one image during the reference period T.

The first scan driver 110 may be driven according to a first frequency P, and the second scan driver 120 may be driven according to a second frequency Q that is lower than the first frequency P. In FIG. 3, an embodiment in which the first frequency P is 60 Hz and the second frequency Q is 1 Hz is representatively illustrated. However, the present disclosure is not limited thereto, and the first frequency P and the second frequency Q may be set to various values as would be understood by those skilled in the art.

For example, the reference period T may be set to one second. The reference period T may correspond to one first frame FP1.

The reference period T may include a first frame FP1 for writing data and at least one second frame FP2 for holding the data.

The number N of at least one second frame FP2 may be 59 (e.g., when the first frequency P is 60 Hz and the second frequency Q is 1 Hz).

Figure 4A:
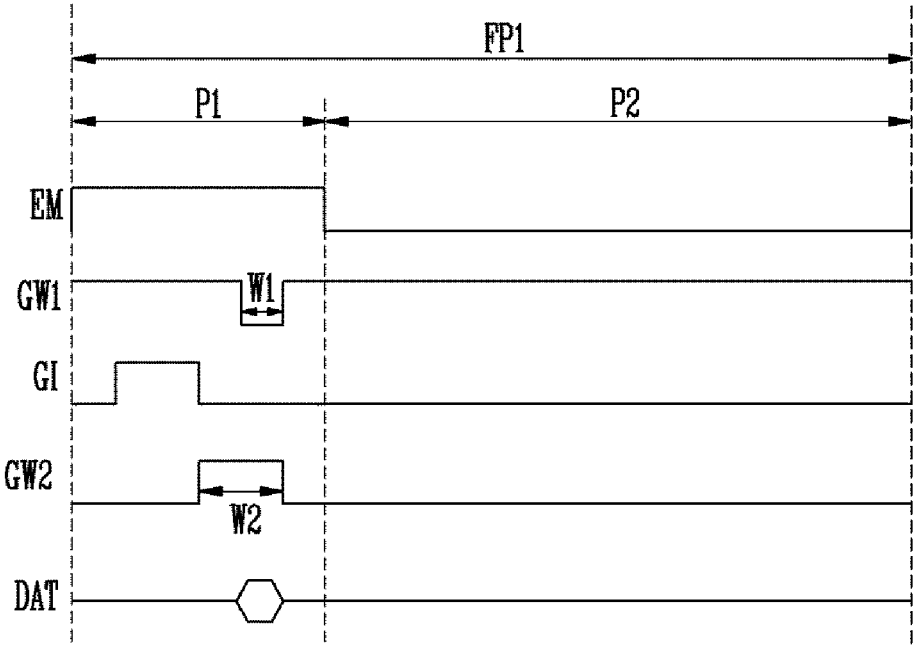
FIGS. 4A and 4B are diagrams illustrating a method of driving the display device during a first frame or a second frame, which is shown in FIG. 3.
Figure 4B:
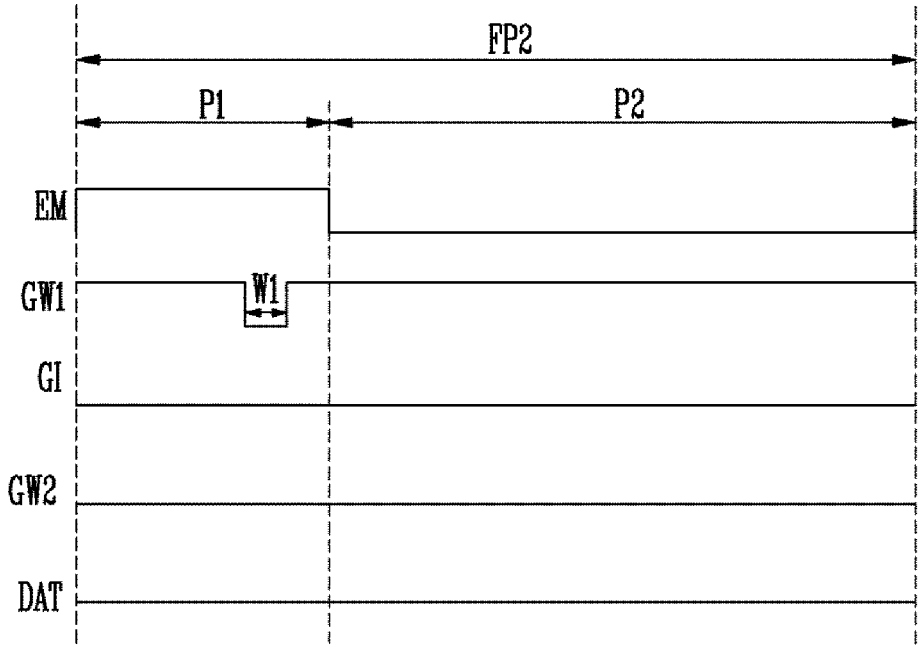

FIGS. 4A and 4B are diagrams illustrating a method of driving the display device during the first frame FP1 or the second frame FP2, according to the method shown in FIG. 3.

A method of driving the display device during the first frame FP1 is illustrated in FIG. 4A, and a method of driving the display device during the second frame FP2 is illustrated in FIG. 4B.

The method of driving the display device during the first frame FP1 is described.

Hereinafter, a case where the emission control signal EM, a first write signal GW1, the initialization signal GI, and the second write signal GW2 have the gate-on voltage is illustrated. In FIGS. 4A and 4B, the gate-on voltage is illustrated as the low level voltage, and a gate-off voltage is illustrated as the high level voltage.

Referring to FIGS. 1-4A, the first frame FP1 may include a first period P1 and a second period P2. For example, the first period P1 may mean a non-emission period, and the second period P2 may mean an emission period. The first period P1 and the second period P2 may be sequentially continued.

During the first period P1, the first write signal GW1 having a first width W1 may be supplied to a corresponding first scan line.

In addition, the initialization signal GI and the second write signal GW2, which have a second width W2, may be sequentially supplied to a corresponding second scan line. In some embodiments, the first width W1 and the second width W2 may be different from each other.

In addition, the data signal DAT having the first width W1 may be supplied to a corresponding data line in synchronization with the second write signal GW2.

In some embodiments, the black signal GB may be a signal that is the same (e.g., identical or substantially identical) as the second write signal GW2.

When the initialization signal GI is supplied, the fourth transistor T4 may be turned on. When the fourth transistor T4 is turned on, the first node N1 may be initialized to the voltage of the third power source Vint.

Next, when the second write signal GW2 is supplied, the third transistor T3 and the fifth transistor T5 may be turned on.

When the third transistor T3 is turned on, the first transistor T1 may be diode-coupled.

When the fifth transistor T5 is turned on, the voltage of the third power source Vint may be applied to the anode electrode of the organic light emitting diode OLED. Therefore, the anode electrode of the organic light emitting diode OLED may be initialized to the voltage of the third power source Vint.

Next, when the first write signal GW1 is supplied, the second transistor T2 may be turned on.

When the second transistor T2 is turned on, the voltage of the data signal DAT supplied to the data line may be applied to the second node N2. A voltage obtained by subtracting the threshold voltage of the first transistor T1 from the voltage of the data signal DAT may be applied to the first node N1. Therefore, the storage capacitor Cst may store a voltage corresponding to the difference between the voltage of the first power source ELVDD and the voltage applied to the first node N1. As described above, the threshold voltage of the first transistor T1 can be compensated.

During the second period P2, the emission control signal EM may be supplied to a corresponding emission control line.

When the emission control signal EM is supplied, the sixth transistor T6 and the seventh transistor T7 may be turned on.

When the sixth transistor T6 and the seventh transistor T7 are turned on, the driving current may flow via the organic light emitting diode OLED, and the organic light emitting diode OLED may generate light (e.g., a predetermined light). Thus, the pixel PX can emit light.

Referring to FIGS. 1-4B, the second frame FP2 may include a first period P1 and a second period P2.

During the first period P1, the first write signal GW1 having a first width W1 may be supplied to a corresponding first scan line.

During the second frame FP2, the initialization signal GI and the second write signal GW2 are not supplied. This is because the first write signal GW1 is generated by the first scan driver 110 driven according to the first frequency P and the second write signal GW2 is generated by the second scan driver 120 driven according to the second frequency Q.

In addition, because the data signal DAT is supplied in synchronization with the second write signal GW2, the data signal DAT is not supplied during the second frame FP2. For example, during the second frame FP2, the corresponding data line may hold a voltage (e.g., a preset voltage).

When the first write signal GW1 is supplied, the second transistor T2 may be turned on.

When the second transistor T2 is turned on, the preset voltage supplied to the data line may be applied to the second node N2. Unlike during the first frame FP1, the third transistor T3 is not turned on, and hence the preset voltage is not supplied to the first node N1. Thus, the first node N1 can hold a voltage from the first frame FP1.

During the second period P2, the emission control signal EM may be supplied to a corresponding emission control line.

When the emission control signal EM is supplied, the sixth transistor T6 and the seventh transistor T7 may be turned on.

When the sixth transistor T6 and the seventh transistor T7 are turned on, the driving current may flow via the organic light emitting diode OLED, and the organic light emitting diode OLED may generate light (e.g., a preset light). Thus, the pixel can emit light.

Thus, based on contents illustrated in FIGS. 3, 4A, and 4B, a plurality of pixels PX can emit light during the reference time T including the first frame FP1 and the second frame FP2.

Figure 5:
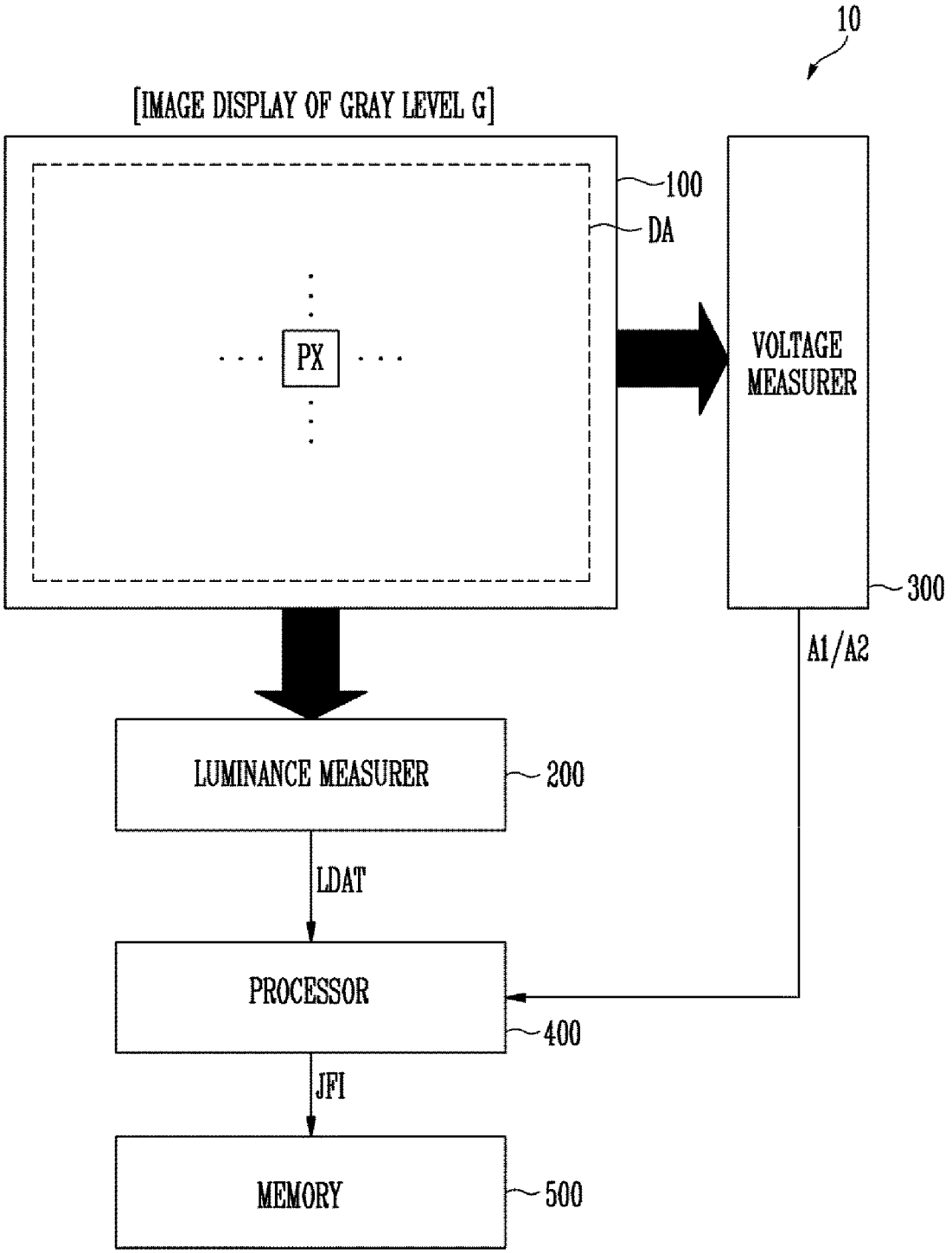
FIG. 5 is a diagram illustrating a flicker quantification system according to an embodiment of the present disclosure.

FIG. 5 is a diagram illustrating a flicker quantification system 10 according to an embodiment of the present disclosure.

Referring to FIGS. 1-5, the flicker quantification system 10 may include a display device 100, a luminance measurer 200, a voltage measurer 300, a processor 400, and a memory 500.

The display device 100 may display an image through a display surface DA during a reference period T. The display surface DA may be an area in which pixels PX are arranged. For example, the display surface DA may correspond to the display unit 140 shown in FIG. 1.

The image may have any gray level among a plurality of gray levels. For example, the image may have any gray level among gray levels 0 to 255.

The luminance measurer 200 may measure a luminance of the display surface DA during the reference period T. The luminance measurer 200 may generate luminance data LDAT by measuring the luminance. For example, the luminance data LDAT represent the luminance of the display surface DA during the reference period T. The luminance measurer 200 may transmit the luminance data LDAT to the processor 400.

The voltage measurer 300 may include photo sensors (e.g., photo diodes), and measure a voltage of each photo sensor corresponding to light emitted from the display surface DA. The voltage measurer 300 may generate first voltage data Al and second voltage data A2 by measuring the voltage generated by the photo sensors. For example, the voltage measurer 300 may further include an oscilloscope for measuring a voltage.

The first voltage data A1 may represent an accumulation amount of voltage during a first frame FP1, and the second voltage data A2 may represent an accumulation amount of voltage during a second frame FP2. For example, the voltage measurer 300 may calculate an accumulation amount by performing integration on the measured voltages. The voltage measurer 300 may transmit the first voltage data A1 and the second voltage data A2 to the processor 400.

The processor 400 may receive the luminance data LDAT, the first voltage data A1, and the second voltage data A2.

In some embodiments, the processor 400 may calculate a flicker index value JFI, using Equation 1.

$$JFI=\{(A1-A2)*LDAT*P\}/\{JND*((A1-A2)*Q+A2*P)\} \quad \text{Equation 1}$$

In Equation 1, JFI denotes the flicker index value, JND denotes a just noticeable difference, P denotes the first frequency, Q denotes the second frequency, A1 denotes the first voltage data, A2 denotes the second voltage data, and LDAT denotes the luminance data.

In various embodiments, the just noticeable difference JND may refer to a minimum strength difference where the difference between two stimulations can be noticed. The just noticeable difference JND may be a value changed for each luminance, i.e., each gray level.

In some embodiments, just noticeable differences for the respective gray levels may be stored in a separate memory (e.g., the memory 500).

Equation 1 may be calculated in the following sequence.

Because the luminance data LDAT represents the luminance during the reference period T, the processor 400 may calculate a conversion variable, using Equation 1-1.

$$K=LDAT/(A1*(Q/P)+A2*(1-Q/P)) \quad \text{Equation 1-1}$$

In Equation 1-1, K denotes the conversion variable, P denotes the first frequency, Q denotes the second frequency, A1 denotes the first voltage data, A2 denotes the second voltage data, and LDAT denotes the luminance data.

In various embodiments, the conversion variable may represent a ratio an average accumulation amount of voltage during the reference period T to the luminance during the reference period T. The conversion variable may be a value changed for each luminance, i.e., each gray level.

The processor 400 may calculate a measured luminance difference using Equation 1-2.

$$F=K(A1-A2) \quad \text{Equation 1-2}$$

In Equation 1-2, F denotes the measured luminance difference, K denotes the conversion variable, A1 denotes the first voltage data, and A2 denotes the second voltage data.

In various embodiments, the measured luminance difference may represent the difference between a luminance during the first frame FP1 and a luminance during the second frame FP2. The measured luminance difference may be a value changed for each luminance, i.e., each gray level.

The processor 400 may calculate a flicker index value, using Equation 1-3.

$$JFI=F/JND \quad \text{Equation 1-3}$$

In Equation 1-3, F denotes the measured luminance difference, and JND denotes the just noticeable difference.

As described above, Equation 1 may be derived through Equations 1-1 to 1-3.

In some embodiments, the processor 400 may calculate the flicker index value JFI, using Equation 2.

$$JFI=\{(A1-A2)*LDAT\}/(JND*A2) \quad \text{Equation 2}$$

In Equation 2, JFI denotes the flicker index value, JND denotes just noticeable difference, A1 denotes the first voltage data, A2 denotes the second voltage data, and LDAT denotes the luminance data.

Equation 2 may be calculated in the following sequence.

Since the luminance data LDAT represents the luminance during the reference period T, the processor 400 may calculate a conversion variable, using Equation 2-1.

$$K=LDAT/A2 \quad \text{Equation 2-1}$$

In Equation 2, K denotes the conversion variable, A2 denotes the second voltage data, and LDAT denotes the luminance data.

Equation 2-1 may be derived from Equation 1-1 through the assumption that the first frequency P is considerably larger than the second frequency Q.

As described above, Equation 2 may be derived from Equation 2-1, Equation 1-2, and Equation 1-3.

The display device 100 may sequentially display images corresponding to a plurality of gray levels G through the display surface DA.

The processor 400 may calculate a flicker index value JFI for each of the plurality of gray levels G. This is defined as a first operation.

For example, the processor 400 may calculate a flicker index value JFI with respect to each of the gray levels 0 to 255.

The second scan driver 120 may be sequentially driven according to a plurality of second frequencies Q.

The processor 400 may perform the first operation on the plurality of second frequencies Q.

For example, the processor 400 may perform the first operation on each of the plurality of second frequencies Q. Performing the first operation on the plurality of second frequencies may be referred to as a second operation.

As a result, the processor 400 may generate a quantification table obtained by sorting the flick index values JFI for each of the plurality of gray levels G and each of the plurality of second frequencies Q.

Also, in some embodiments, the first scan driver 110 may be sequentially driven according to a plurality of first frequencies P.

The processor 400 may perform the second operation on the plurality of first frequencies P.

For example, the processor may perform the second operation on each of the plurality of first frequencies P.

As a result, the processor 400 may generate a quantification table obtained by sorting the flick index values JFI for each of the plurality of gray levels G, for each of the plurality of first frequencies P, and each of the plurality of second frequencies Q.

In some embodiments, the processor 400 may be an application processor (AP), a central processing unit (CPU), a graphics processing unit (GPU), a micro controller unit (MCU), or another host system as would be understood by those skilled in the art.

The memory 500 may store the quantification table generated by the processor 400. In some embodiments, the memory 500 may be a flash memory.

Figure 6A:
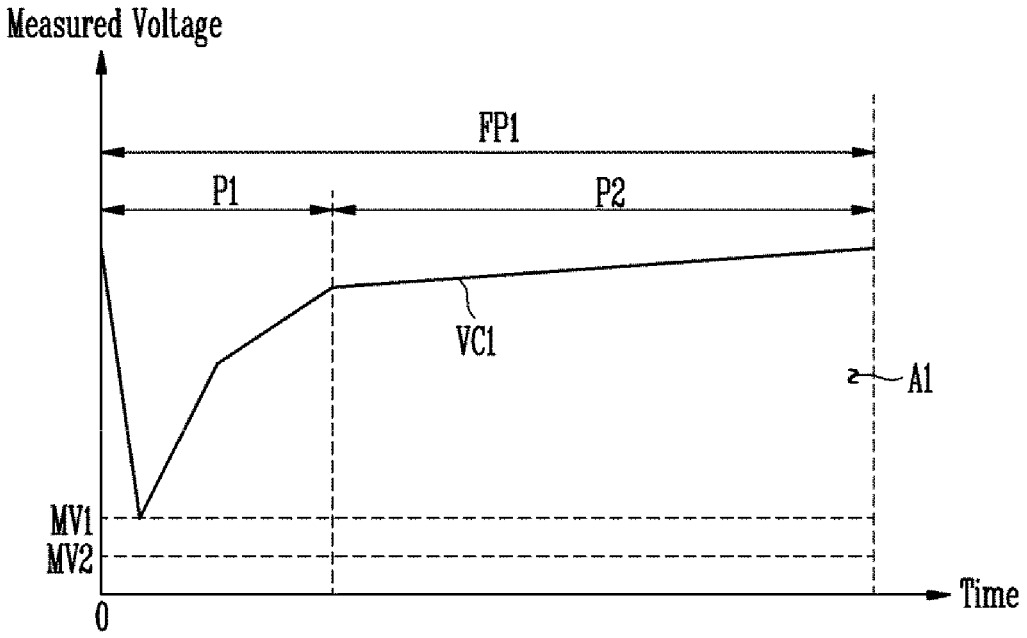
FIGS. 6A and 6B are diagrams illustrating first voltage data and second voltage data according to an embodiment of the present disclosure.
Figure 6B:
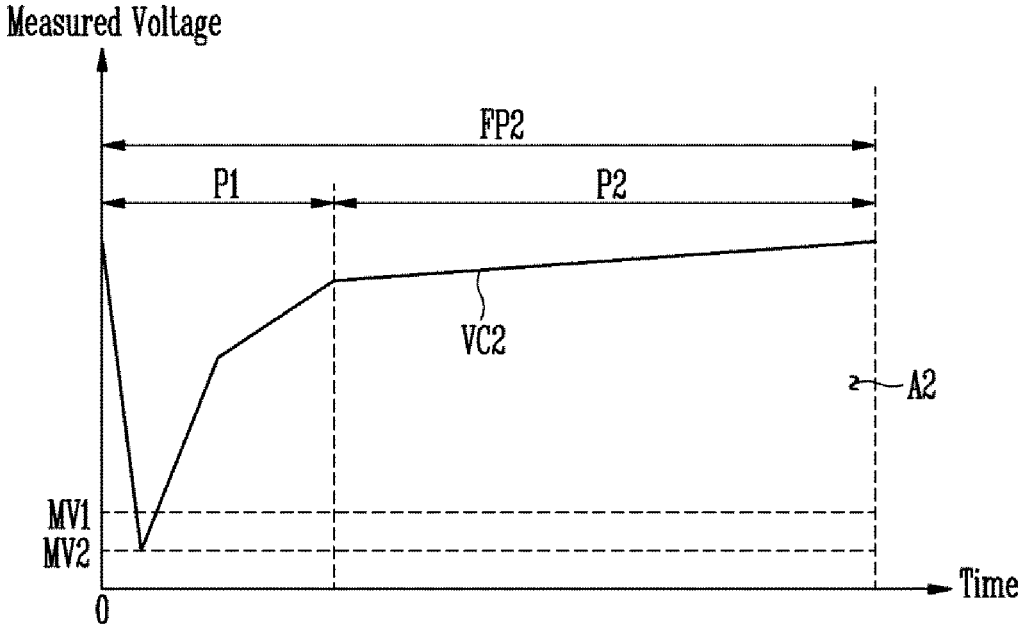

FIGS. 6A and 6B are diagrams illustrating first voltage data A1 and second voltage data A2 according to an embodiment of the present disclosure.

A first measured voltage curve VC1 during a first frame FP1 is illustrated in FIG. 6A, and a second measured voltage curve VC2 during a second frame FP2 is illustrated in FIG. 6B.

Referring to FIGS. 5, 6A and 6B, the voltage measurer 300 shown in FIG. 5 may include photo sensors (e.g., photo diodes), and be configured to measure a voltage of a photo sensor corresponding to light emitted from the display surface DA.

During the first frame FP1, the first measure voltage curve VC1 may be lowered down to a first reference value MV1. During the second frame FP2, the second measured voltage curve VC2 may be lowered down to a second reference value MV2.

The first reference value MV1 and the second reference value MV2 may be different from each other.

The first voltage data A1 may represent an accumulation amount of voltage during the first frame FP1, and the second voltage data A2 may represent an accumulation amount of voltage during the second frame FP2.

Therefore, the first voltage data A1 and the second voltage data A2 may be different from each other. For example, the first voltage data A1 may be larger than the second voltage data A2.

Figure 7:
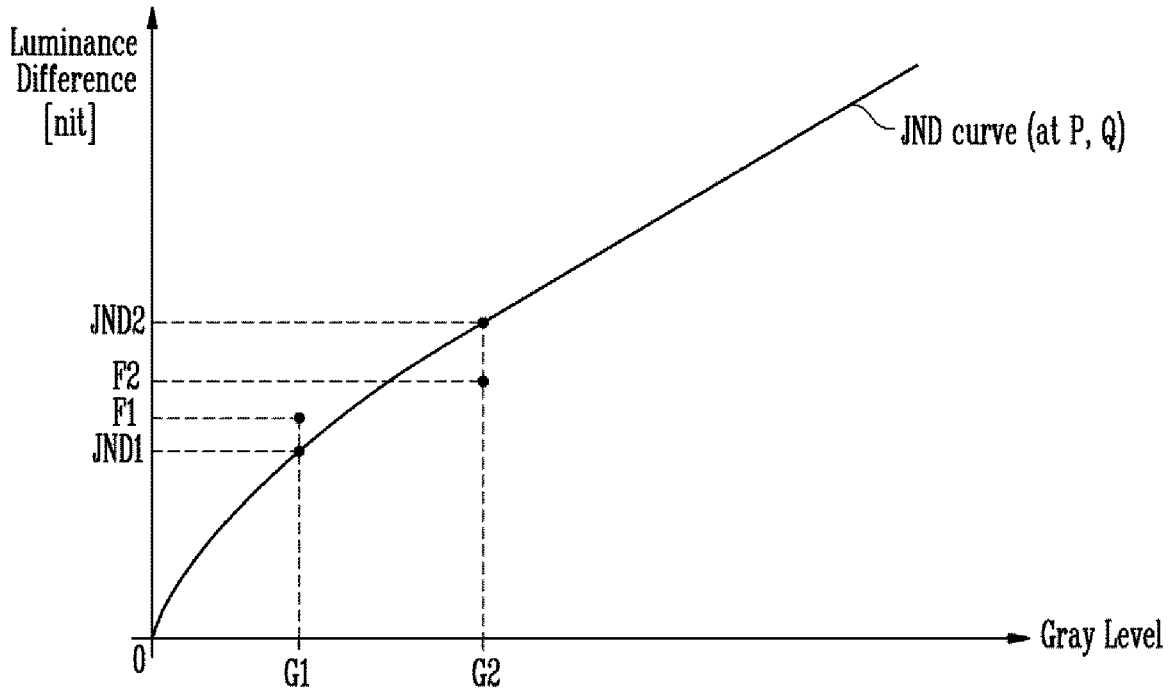
FIG. 7 is a diagram illustrating a method of driving a processor provided in the flicker quantification system according to an embodiment of the present disclosure.

FIG. 7 is a diagram illustrating a method of driving the processor 400 provided in the flicker quantification system 10 according to an embodiment of the present disclosure.

Referring to FIGS. 5 and 7, the processor 400 may calculate a first measured luminance difference F1 with respect to a first gray level G1. The processor may calculate a second measured luminance difference F2 with respect to a second gray level G2.

The processor 400 may read a just noticeable difference curve JND curve representing a just noticeable difference for each gray level from a separate memory (e.g., the memory 500).

For example, the processor 400 may acquire, from the just noticeable difference curve JND curve, a first just noticeable difference JND1 with respect to the first gray level G1 and a second just noticeable difference JND2 with respect to the second gray level G2.

In various embodiments, the processor 400 may calculate flicker index values JFI with respect to the first gray level G1 and the second gray level G2.

FIGS. 8A and 8B are diagrams illustrating a quantification table according to an embodiment of the present disclosure.

Referring to FIG. 8A, the quantification table may include a first frequencies P, second frequencies Q, and flicker index values JFI with respect to gray levels G.

For example, the quantification table may include flicker index values JFI with respect to the first frequency P of 60 Hz. The quantification table may include flicker index values JFI with respect to the second frequencies Q of 1 Hz to 59 Hz. Also, the quantification table may include flicker index values JFI with respect to the gray levels G of gray levels 0 to 255.

In some embodiments, the quantification table may further include comparison values CV corresponding to the flicker index values JFI.

The comparison value CV may represent 1 when the flicker index value JFI is equal to or larger than 1. The comparison value CV may represent 0 when the flicker index value JFI is smaller than 1.

FIG. 8B illustrates a quantification table further expanded as compared with the quantification table shown in FIG. 8A.

Referring to FIG. 8B, the quantification table may include first frequencies P, second frequencies Q, and flicker index values JFI with respect to gray levels G.

For example, the quantification table may include flicker index values JFI with respect to the first frequencies P of 60 Hz or more. The quantification table may include flicker index values JFI with respect to no less than 0.1 Hz and the second frequencies Q smaller than the first frequencies P. Also, the quantification table may include flicker index values JFI with respect to the gray levels G of gray levels 0 to 255.

In some embodiments, the quantification table may further include comparison values CV corresponding to the flicker index values JFI.

The comparison value CV may represent 1 when the flicker index value JFI is equal to or larger than 1. The comparison value CV may represent 0 when the flicker index value JFI is smaller than 1.

As shown in FIGS. 8A and 8B, the quantification tables may be generated with respect to the first and second frequencies P and Q in more various ranges.

Figure 9:
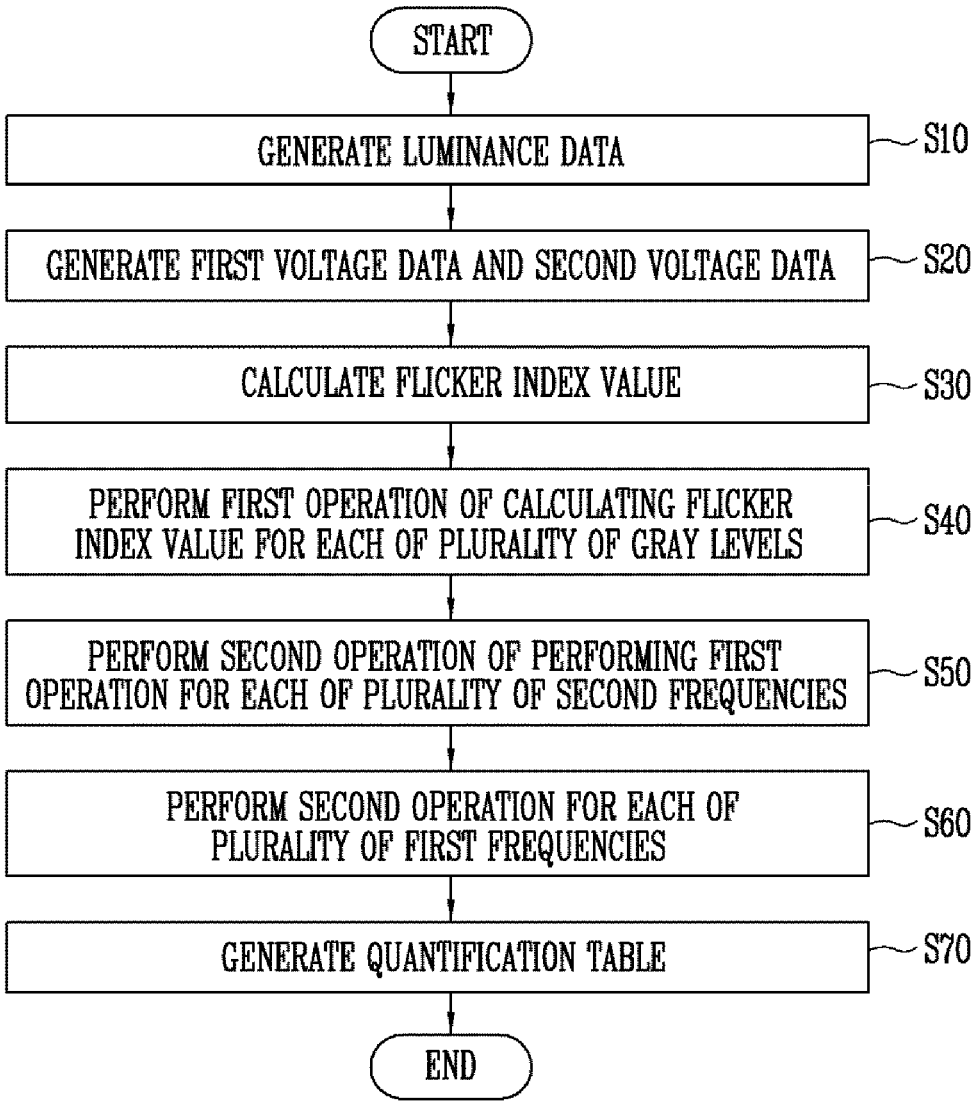
FIG. 9 is a flowchart illustrating a method of driving the flicker quantification system according to an embodiment of the present disclosure.

FIG. 9 is a flowchart illustrating a method of driving the flicker quantification system 10 according to an embodiment of the present disclosure.

Hereinafter, the method of driving the flicker quantification system 10 is described with reference to FIGS. 1-9.

The luminance measurer 200 may generate luminance data LDAT (S10). For example, the luminance measurer 200 may generate the luminance data LDAT by measuring a luminance of the display surface DA during a reference period T.

The voltage measurer 300 may generate first voltage data A1 and second voltage data A2 (S20). For example, the voltage measurer 300 may generate the first voltage data A1 and the second voltage data A2 by measuring a voltage of the photo sensor.

The processor 400 may calculate a flicker index value JFI (S30). For example, the processor 400 may calculate the flicker index value JFI, using Equation 1.

$$JFI=\{(A1-A2)*LDAT*P\}/\{JND*((A1-A2)*Q+A2*P)\} \quad \text{Equation 1}$$

Where JFI denotes the flicker index value, JND denotes a just noticeable difference, P denotes a first frequency, Q denotes a second frequency, A1 denotes the first voltage data, A2 denotes the second voltage data, and LDAT denotes the luminance data.

The processor 400 may perform a first operation of calculating a flicker index value JFI for each of a plurality of gray levels (S40). For example, the processor 400 may calculate a flicker index value JFI with respect to each of the gray levels 0 to 255.

The processor 400 may perform a second operation of performing the first operation for each of a plurality of second frequencies Q (S50). For example, the processor 400 may perform the first operation with respect to each of the plurality of second frequencies Q.

The processor 400 may perform the second operation for each of a plurality of first frequencies P (S60). For example, the processor 400 may perform the second operation with respect to each of the first frequencies P.

The processor 400 may generate a quantification table (S70). For example, the processor 400 may generate a quantification table obtained by sorting the flicker index values JFI for each of the plurality of gray levels G, each of the plurality of first frequencies P, and each of the plurality of second frequencies Q.

In the flicker quantification system and the method of driving the same according to the embodiment of the present disclosure, a flicker occurrence condition of the display device according to a driving frequency can be quantified.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims and their equivalents.

What is claimed is:

1. A flicker quantification system comprising:

a display device configured to be driven according to a unit of a reference period comprising a first frame for writing data and at least one second frame for holding the data;

a luminance measurer configured to generate luminance data by measuring a luminance of a display surface of the display device during the reference period;

a voltage measurer configured to measure a voltage of a photo sensor corresponding to light emitted from the display surface, and to generate first voltage data representing an accumulation amount of the voltage during the first frame and second voltage data representing an accumulation amount of the voltage during the at least one second frame; and a processor configured to calculate a flicker index value representing a ratio of a measured luminance difference to a just noticeable difference, based on the luminance data, the first voltage data, and the second voltage data, wherein the measured luminance difference represents the difference between a luminance during the first frame and a luminance during the at least one second frame.

2. The flicker quantification system of claim 1, wherein the display device comprises:

pixels coupled to first scan lines, second scan lines, data lines, and emission control lines;

a first scan driver configured to be driven according to a first frequency, the first scan driver being configured to supply first scan signals to the first scan lines;

a second scan driver configured to be driven according to a second frequency different from the first frequency, the second scan driver being configured to supply second scan signals to the second scan lines;

a data driver driven according to the second frequency, the data driver being configured to supply data signals to the data lines; and an emission driver configured to supply emission control signals to the emission control lines according to the first frequency.

3. The flicker quantification system of claim 2, wherein the processor is configured to calculate the flicker index value according to:

$$JFI=\{(A1-A2)*LDAT*P\}/\{JND*((A1-A2)*Q+A2*P)\},$$

wherein JFI denotes the flicker index value, JND denotes the just noticeable difference, P denotes the first frequency, Q denotes the second frequency, A1 denotes the first voltage data, A2 denotes the second voltage data, and LDAT denotes the luminance data.

4. The flicker quantification system of claim 3, wherein the display device is configured to sequentially display images corresponding to a plurality of gray levels, wherein the processor is configured to perform a first operation of calculating the flicker index value for each of the plurality of gray levels.

5. The flicker quantification system of claim 4, wherein the second scan driver is configured to be sequentially driven according to a plurality of second frequencies, wherein the processor is configured to perform a second operation of performing the first operation for each of the plurality of second frequencies.

6. The flicker quantification system of claim 5, wherein the processor is configured to generate a quantification table obtained by sorting the flicker index values for each of the plurality of gray levels and each of the plurality of second frequencies.

7. The flicker quantification system of claim 6, wherein the first scan driver is configured to be sequentially driven according to a plurality of first frequencies, wherein the processor is configured to perform the second operation for each of the plurality of first frequencies.

8. The flicker quantification system of claim 7, wherein the processor is configured to generate a quantification table by sorting the flicker index values for each of the plurality of gray levels, each of the plurality of first frequencies, and each of the plurality of second frequencies.

9. The flicker quantification system of claim 1, wherein the processor is configured to calculate the flicker index value according to:

$$JFI=\{(A1-A2)*LDAT\}/(JND*A2),$$

wherein JFI denotes the flicker index value, JND denotes the just noticeable difference, A1 denotes the first voltage data, A2 denotes the second voltage data, and LDAT denotes the luminance data.

10. The flicker quantification system of claim 2, wherein the first frequency is larger than the second frequency.

11. The flicker quantification system of claim 10, wherein the first frequency is 60 Hz.

12. A method of driving a flicker quantification system, the method comprising:

generating luminance data by measuring a luminance of a display surface of a display device during a reference period, wherein the display device is driven in the unit of the reference period, wherein the reference period comprises a first frame for writing data and at least one second frame for holding the data;

measuring a voltage of a photo sensor corresponding to light emitted from the display surface, and generating first voltage data representing an accumulation amount of the voltage during the first frame and second voltage data representing an accumulation amount of the voltage during the at least one second frame; and calculating a flicker index value representing a ratio of a measured luminance difference to a just noticeable difference, based on the luminance data, the first voltage data, and the second voltage data, wherein the measured luminance difference represents the difference between a luminance during the first frame and a luminance during the at least one second frame.

13. The method of claim 12, wherein the display device comprises:

pixels coupled to first scan lines, second scan lines, data lines, and emission control lines;

a first scan driver configured to be driven according to a first frequency, the first scan driver being configured to supply first scan signals to the first scan lines;

a second scan driver configured to be driven according to a second frequency different from the first frequency, the second scan driver being configured to supply second scan signals to the second scan lines;

a data driver configured to be driven according to the second frequency, the data driver being configured to supply data signals to the data lines; and an emission driver configured to supply emission control signals to the emission control lines according to the first frequency.

14. The method of claim 13, wherein the display device sequentially displays images corresponding to a plurality of gray levels, wherein the method further comprises performing a first operation of calculating the flicker index value for each of the plurality of gray levels.

15. The method of claim 14, wherein the second scan driver is sequentially driven according to a plurality of second frequencies, wherein the method further comprises performing a second operation of performing the first operation for each of the plurality of second frequencies.

16. The method of claim 15, further comprising generating a quantification table obtained by sorting the flicker index values for each of the plurality of gray levels and each of the plurality of second frequencies.

17. The method of claim 13, wherein the flicker index value is calculated using:

$$JFI=\{(A1-A2)*LDAT*P\}/\{JND*((A1-A2)*Q+A2*P)\},$$

wherein JFI denotes the flicker index value, JND denotes the just noticeable difference, P denotes the first frequency, Q denotes the second frequency, A1 denotes the first voltage data, A2 denotes the second voltage data, and LDAT denotes the luminance data.

18. The method of claim 12, wherein the flicker index value is calculated using:

$$JFI=\{(A1-A2)*LDAT\}/(JND*A2),$$

wherein JFI denotes the flicker index value, JND denotes the just noticeable difference, A1 denotes the first voltage data, A2 denotes the second voltage data, and LDAT denotes the luminance data.

* * * * *